US007779857B2

(12) United States Patent
Acker

(10) Patent No.: US 7,779,857 B2
(45) Date of Patent: Aug. 24, 2010

(54) HOT WATER SYSTEM

(75) Inventor: Larry K. Acker, Costa Mesa, CA (US)

(73) Assignee: ACT, Inc., Costa Mesa, CA (US)

( * ) Notice: Subject to any disclaimer, the term of this patent is extended or adjusted under 35 U.S.C. 154(b) by 335 days.

(21) Appl. No.: 11/724,794

(22) Filed: Mar. 16, 2007

(65) Prior Publication Data

US 2008/0223451 A1 Sep. 18, 2008

(51) Int. Cl.
*F16L 53/00* (2006.01)

(52) U.S. Cl. ..... 137/337

(58) Field of Classification Search ..... 137/337, 137/571; 236/12.11
See application file for complete search history.

(56) References Cited

U.S. PATENT DOCUMENTS 4,321,943 A 3/1982 Haws
4,363,221 A * 12/1982 Singh ..... 62/238.6
4,798,224 A 1/1989 Haws
5,009,572 A * 4/1991 Imhoff et al. ..... 417/32
5,042,524 A 8/1991 Lund
5,205,318 A * 4/1993 Massaro et al. ..... 137/337
5,227,219 A 7/1993 Bayer et al.
5,829,475 A 11/1998 Acker
6,962,162 B2 * 11/2005 Acker ..... 137/1
7,140,382 B2 11/2006 Kempf et al.
2008/0061155 A1 * 3/2008 Seymour ..... 236/12.11

* cited by examiner

*Primary Examiner*—Stephen Hepperle
*Assistant Examiner*—Macade Brown
(74) *Attorney, Agent, or Firm*—Walter A. Hackler

(57) ABSTRACT

A hot water system includes a hot water source; a hot water delivery line connected between the hot water source and at least one plumbing fixture along with a cold water delivery line connection between said plumbing fixture, a cold water source and said hot water source; a pump, interconnected between the hot and cold water delivery lines, enables circulation of water from the hot water delivery line through the cold water delivery line and into the hot water source, thus eliminating the need for a separate recirculation line. A thermostatic valve is disposed in a serial arrangement with the pump between the hot and cold water lines for blocking flow of water from the hot water line into the cold water line when the pump is not operating.

6 Claims, 2 Drawing Sheets

HOT WATER SYSTEM

The present invention is generally directed to plumbing systems and more particularly directed to plumbing systems of high thermal efficiency.

As described in U.S. Pat. Nos. 4,321,943 and 4,798,224, a considerable amount of thermal energy may be wastefully dissipated from hot water lines which provide hot water to plumbing fixtures, such as domestic wash basins, dishwashers and clothes washers. In addition, if water is allowed to run down the drain while waiting for hot water to be delivered to the fixture from a remote hot water source, a substantial water loss may occur.

In order to reduce such water loss, plumbing systems have been devised which continuously circulate hot water from a hot water source to the fixture and back to the hot water source. In this arrangement, a supply of hot water is always adjacent to a plumbing fixture despite the remote position of the hot water source. The water loss is then limited to the amount of cold water disposed in draw pipes interconnecting the plumbing fixture to the hot water conduit in which hot water is circulated.

While this system substantially reduces the amount of water which must be withdrawn from the fixture before suitable hot water is obtained, it is not energy efficient because the array of pipes interconnecting the plumbing fixtures in the hot water source provide an enormous surface area for thermal radiation therefrom. In addition, the electrical cost of running a circulating pump may cause such system to be prohibitive in view of the latest energy conscious code requirements of most governmental agencies.

Thermal losses in both circulating and noncirculating plumbing systems have been reduced by insulation of the hot water lines as well as the hot water heaters which feed the plumbing fixtures. While such insulation slows the dissipation of heat, no savings occur over an extended period of time in noncirculating systems because intermittent use of hot water through the lines still allows hot water to cool to ambient temperatures. In circulating systems, of course, there is a continual thermal loss.

With specific reference to noncirculating systems, devices have been developed to actually recover the hot water remaining in the hot water lines after the use of a fixture by drawing the hot water back into the hot water tank; e.g., see U.S. Pat. Nos. 4,321,943 and 4,798,224. Because hot water is removed from the lines, there is an actual reduction in the amount of heat loss rather than just a slowing of heat loss as occurs through the use of insulation alone.

U.S. Pat. No. 5,042,524, is directed to an accelerated hot water delivery system which substantially reduces thermal losses by providing intermittent circulation through the hot water lines.

U.S. Pat. No. 5,277,219 utilizes the cold water line as a return line for a hot water loop. This enables the system to be readily retrofitted into existing homes without the need for the installation of a return line to the hot water heater. However, such system may experience unwanted water flow when the circulation pump is not operating and a pressure differential occurs between the hot or cold water do to use of water from remote parts of the water system. That is, when the pump is not operating a back flow of water from the cold water line into the hot water line can occur. The present invention overcomes that problem.

SUMMARY OF THE INVENTION

A hot water delivery system in accordance with the present invention generally includes a hot water source and hot water delivery lines connected between the hot water source and at least one plumbing fixture. A cold water delivery line is provided and connected between the plumbing fixture and a cold water source and the hot water source for delivering cold water thereto.

A pump is provided which is interconnected between the hot and cold water delivery lines, for circulation of the water from the hot water delivery line through the cold water delivery and into the hot water source. A controller provides for causing the pump to circulate water from the hot water line into the cold water line and back to the hot water source when a hot water valve on the fixture is turned on.

When the pump is not operating a thermostatic valve blocks backflow of the cold water into the hot water line.

A temperature sensor, connected to the control system, may be provided for causing the controller to stop the pump to prevent heated water from being circulated to the cold water delivery lines.

The cold water delivery lines are used as a return loop for water to the hot water source, which eliminates the need for installation of a separate return line as is common in circulating water systems. Hence, the apparatus of the present invention may be readily installed adjacent to one plumbing fixture in an existing system without the installation of additional plumbing return lines which requires substantial modification to an existing plumbing system, entailing the removal of wallboard and/or plaster for installation within walls and cutting into concrete foundation slabs.

Manual switches may be provided and connected to the controller for causing the controller to turn on the pump, alternatively a flow detector may be installed in the hot water delivery line and connected to the controller for automatically causing the controller to turn on the pump.

In an alternative embodiment of the present invention, a hot water return line is utilized in combination with a thermostatic valve.

BRIEF DESCRIPTION OF THE DRAWINGS

The advantages and features of the present invention will appear from the following description when considered in conjunction with the accompanying drawing, in which.

DETAILED DESCRIPTION OF THE DRAWINGS

Figure 1:
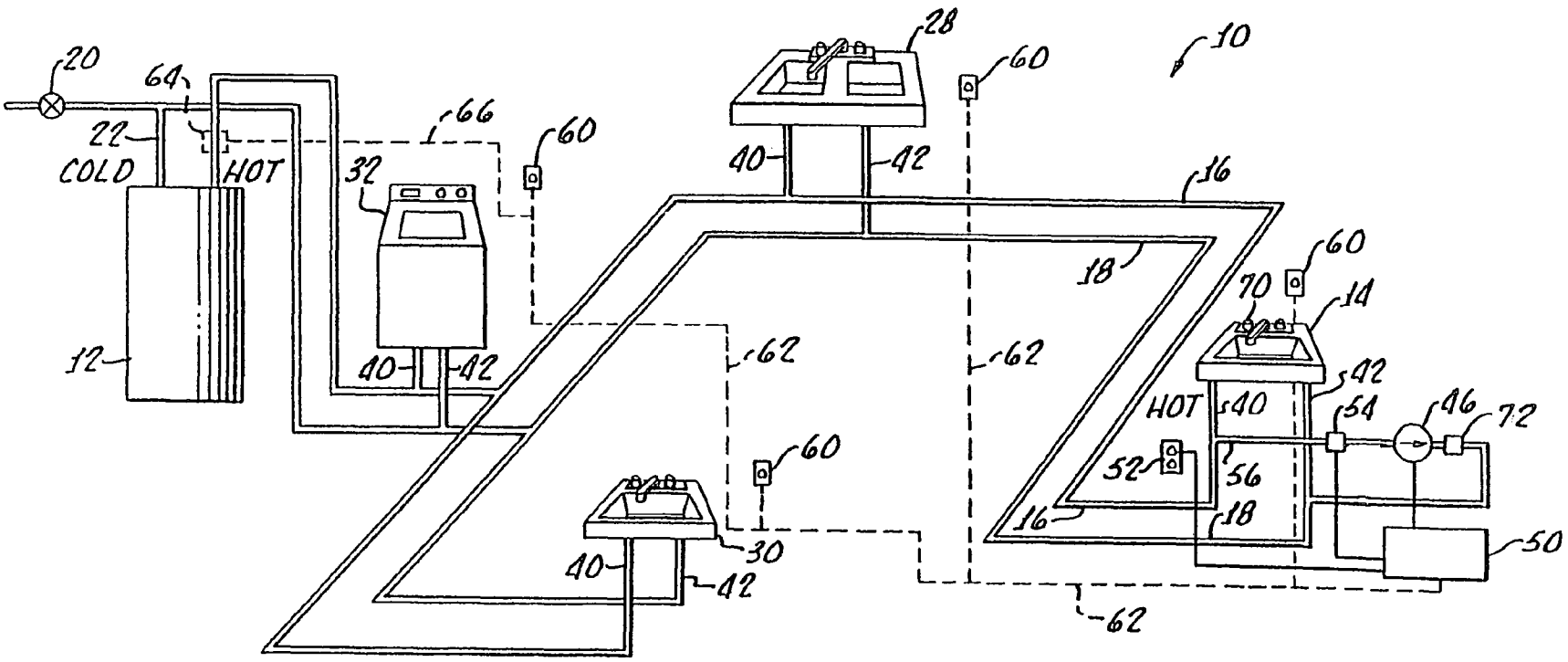
FIG. 1 is a flow diagram of a plumbing system in accordance with the present invention, generally showing hot water source and conduit means, in communication with at least one plumbing fixture, along with a pump, flow switch, controller, and thermostatic valve.

Referring to FIG. 1, there is shown a hot water recovery system 10 which generally includes a hot water source 12, such as a gas or electric tank or tankless hot water heater, boiler or any other hot water provider, connected to a plumbing fixture such as a sink 14 by a hot water delivery line 16. It is to be appreciated that the hot water source 12 may also be a conventional heater as shown or an apparatus as described in U.S. Pat. No. 4,798,224, entitled "Automatic Hot Water Recovery System," or that shown in U.S. patent application Ser. No. 562,894, now U.S. Pat. No. 5,042,524, entitled "Demand Recovery System". Also provided in a conventional manner is a cold water delivery line 18 interconnecting the sink 14 with a cold water source 20 which is also interconnected with the hot water source 12 via a feed line 22.

Optional plumbing fixtures such as sinks 28, 30 and washing machine 32 may be provided along with any other common plumbing fixture utilized in residences and businesses, all such fixtures being connected in a parallel configuration with the hot water delivery line 16 and cold water delivery line 18 by feed lines 40 and 42, respectively.

At a selected plumbing fixture, such as the sink 14 which is most remote from the hot water source 12, a pump 46 is interconnected between the hot water delivery line 16 and the cold water delivery line 18 via the feed lines 40 42 respectively. The pump provides for circulating water from the hot water delivery line 16 through the cold water delivery line 18 and back into the hot water source 12 via line 22, by utilizing the cold water delivery line as a return feeder to the hot water source 12. No separate circulation line need be implemented in new systems. In order for the pump 46 to effect flow in a reverse manner through the cold water delivery line 18 and into the hot water source 12, the pump 46 must, of course, develop sufficient head to overcome existing water pressure in the line.

The hot water delivery system 10 of the present invention can be used in conjunction with an existing system, which may include the hot water source 12, hot and cold water delivery lines 16, 18, and the sink 14. In this instance, the pump 46 and controller 50, to be described hereinafter in greater detail may be installed approximate the sink 14 without disturbing the remainder of the existing plumbing system. The advantages of this embodiment are significant in that no unwanted disruption of the housing or business structure is needed in order to implement the hot water recovery system in accordance with the present invention.

A controller 50, which may be of any common electrical type employing relays or solid state electronics or microchips, provides for switching electrical current outlet 52 to the pump 46 in order to cause the pump 46 to circulate water from the hot water line 16 to the cold water line 18.

A temperature sensor 54 is disposed in a line 56 interconnecting the pump 46 with the hot water delivery line 16 through the feed line 40, providing means for causing the control means to stop the pump 46 to prevent heated water from being circulated through the cold water delivery line 18 as will be hereinafter described. The temperature sensor 54 may be of a conventional type inserted into the line 56 for water flow thereover, or it may be a thermistor type of detector strapped to the outside of the line 56. The sensor 54 may be of a type for detecting a selected water temperature and in response thereto causing the control system to stop the pump 46.

However, it has been found that the sensitivity of such sensors may not be sufficient to prevent unwanted hot water from entering the cold water delivery line 18. Thus, the preferred embodiment of the present invention is a temperature sensor 54 which is configured for detecting a temperature increase, or gradient, such as one or two degrees and in response thereto, causing the control system 52 stop the pump 46. Thus, no matter what the actual temperature of the water in the line 56 is, an increase of one or two degrees will cause the pump 46 to stop. The pump 46 is started through the controller 50 by means of optional manual switches 60 electrically connected to the controller 50 by way of wires 62 for causing the control system to turn on the pump 46, the control system in this manner acting as a relay switch. Alternatively, to reduce electrical wiring costs, a flow detector 64 may be disposed in the hot water delivery line 18 at any position and connected to the control system by an electrical wire 66 for causing the control system 52 to turn on the pump 46 in response to a detection of a water flow in the hot water delivery line 18.

Although the flow detector 64 is shown adjacent to the hot water source 12, it may be alternatively disposed in the feed line 40 beneath the sink 14 for reducing the electrical interconnection required and for enabling all of the apparatus of the present invention to be disposed beneath the sink 14. Either the manual switches 60 or flow detector 64 enables the control means 52 to turn on the pump 46 when a hot water valve 70 on the sink 14 is turned on, thus causing a flow in the hot water delivery line 18.

In order to prevent flow of water from the hot water line 16 into the cold water line 18 when the pump 46 is not operating, a thermostat valve 72 is disposed in a serial arrangement with the pump 46 between the hot water source 12 and the cold water line 18 as hereinabove noted. Suitable thermostatic valves 72 are available from Reliance Worldwide Corporation. A typical thermostat valve 72 will be open at all temperatures below 100° F. and closed at temperatures above 100° F. Other operational temperatures may be utilized depending on water flow and temperature conditions.

Figure 2:
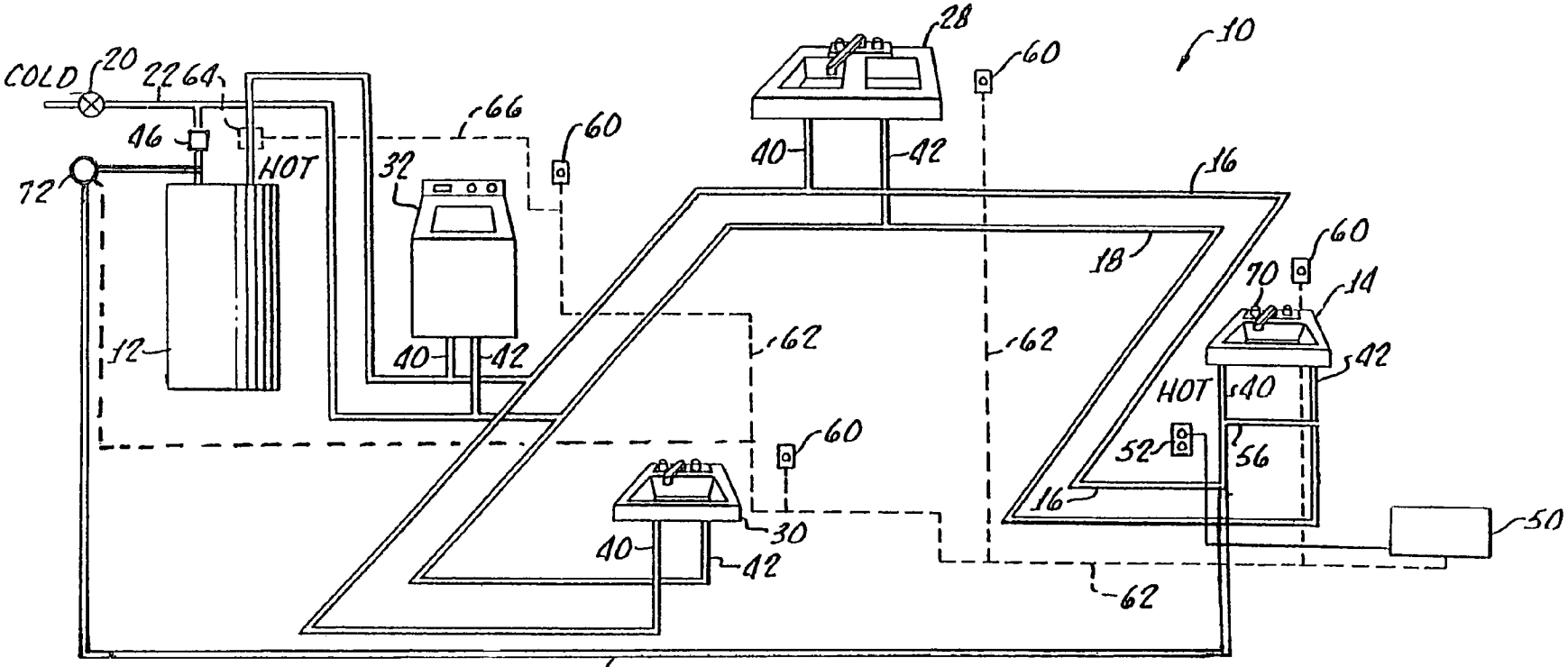
FIG. 2 is a flow diagram of an alternative plumbing system in accordance with the present invention showing a hot water return line and a thermostatic valve.

An alternative embodiment 100 of the present invention is shown in FIG. 2. Common reference numbers designate identical or substantially the same components as described in connection with FIG. 1.

In this embodiment 100, a hot water return line 102 is provided and connected to the hot water delivery line 16 proximate the sink 14 and the hot water source 12 through pump 46. The thermostat valve 72 is disposed between the pump 46 and the cold water source for blocking flow of water from the hot water source into the cold water line.

Although there has been hereinabove described a specific hot water system in accordance with the present invention for the purpose of illustrating the manner in which the invention may be used to advantage, it should be appreciated that the invention is not limited thereto. That is, the present invention may suitably comprise, consist of, or consist essentially of the recited elements. Further, the invention illustratively disclosed herein suitably may be practiced in the absence of any element which is not specifically disclosed herein. Accordingly, any and all modifications, variations or equivalent arrangements which may occur to those skilled in the art, should be considered to be within the scope of the present invention as defined in the appended claims.

What is claimed is:

1. A hot water system comprising:

a hot water source;

a hot water delivery line connected between said hot water source and at least one plumbing fixture;

a cold water delivery line connection between said plumbing fixture, a cold water source and said hot water source;

a pump connected between the hot and cold water delivery lines, at a point remote from said hot water source, and proximate the plumbing fixture for circulation of water from the hot water delivery line through the cold water delivery line and into the hot water source;

a controller for causing the pump means to circulate water from the hot water line into the cold water line proximate said plumbing fixture and back to the hot water source when a plumbing fixture hot water valve is turned on;

a temperature sensor, connected to said control means, for causing said controller to stop the pump in order to prevent heated water from being circulated through the cold water delivery line; and a thermostatic valve disposed in a serial arrangement with said pump between the hot and cold water lines, for blocking flow of water from the hot water line into the cold water line when said pump is not operating, operation of said thermostatic valve being independent from said temperature sensor, and controlled at a separate temperature setting.

2. The hot water system according to claim 1 further comprising a manual switch, connected to said controller, for causing the controller to turn on the pump.

3. The hot water system according to claim 1 further comprising a flow detector, disposed in said hot water delivery line and connected to said controller, for causing the controller to turn on the pump.

4. The hot water system according to claim 1 wherein said temperature sensor is disposed in a water line connecting the hot water delivery line and the pump.

5. The hot water system according to claim 4 wherein said temperature sensor is configured for detecting a selected water temperature and in response thereto causing the controller to stop the pump.

6. The hot water system according to claim 4 wherein said temperature sensor is configured for detecting a temperature increase and in response thereto causing the controller to stop the pump.

* * * * *